United States Patent [19]

Tsuda et al.

[11] 4,207,057

[45] Jun. 10, 1980

[54] FIXING DEVICE FOR USE IN ELECTROPHOTOGRAPHIC COPYING MACHINE

[75] Inventors: Shinichi Tsuda; Yoshio Nakajo; Kenkichi Tagawa; Hayami Hirai; Shunji Takagi, all of Ebina, Japan

[73] Assignee: Rank Xerox, Ltd., London, England

[21] Appl. No.: 689,767

[22] Filed: May 25, 1976

[30] Foreign Application Priority Data

Jun. 16, 1975 [JP] Japan ..... 50-80563[U]

[51] Int. Cl.[2] ..... F27B 9/28

[52] U.S. Cl. ..... 432/59; 118/60; 355/14 FU; 355/3 FU; 427/375; 432/60; 430/124

[58] Field of Search ..... 219/216; 34/108, 110, 34/120; 432/59, 60; 427/22, 375; 118/60; 101/DIG. 13; 355/3 FU, 14; 425/308

[56] References Cited

U.S. PATENT DOCUMENTS

| | | | |
|---|---|---|---|
| 932,587 | 8/1909 | Sheldon | 432/60 |
| 3,409,280 | 11/1968 | Springett | 432/59 |
| 3,492,458 | 1/1970 | White et al. | 219/216 |
| 3,666,247 | 5/1972 | Banks | 432/59 X |
| 3,797,127 | 3/1974 | Yamada et al. | 432/60 X |

*Primary Examiner*—Shrive P. Beck

[57] ABSTRACT

A contact fusing apparatus comprising a heated roll structure cooperating with a pressure roll structure to form a nip through which support material carrying toner images thereon is moved with the toner images contacting the heated roll structure. The contact fuser is characterized by the provision of stripping means for insuring removal of the support material from the heated fuser roll and a roller structure interposed between the stripper means and the nip which roller contacts the support material to thereby restrain the material while the leading portion of the material is being stripped from the heated roll structure. The result of stripping while restraining is to minimize the degree of curling of the copy paper.

4 Claims, 2 Drawing Figures

FIXING DEVICE FOR USE IN ELECTROPHOTOGRAPHIC COPYING MACHINE

DETAILED DESCRIPTION OF THE INVENTION

This invention relates to a heat and pressure fixing device for utilization in electrographic copying machines and more particularly to a so-called heated roll fixing device of the type commonly used in electrophotographic copying machines.

Conventionally, the so-called heated roll fixing of the contact-heat type has been widely used in electrophotographic copying machines for fixing toner images to support material. This type of fixing device has the advantages that it operates under relatively low power and there is no risk of fire such as associated with other types of fusers. However, since a toner image supporting material, such as, paper having thermoplastic powder or toner images, directly contacts the heated roll structure, this type of arrangement has the disadvantage that the toner image supporting material adheres to the surface of the roll and winds around the heated roll structure. Heretofore, in order to prevent the winding or wrapping of the support material around the fuser roll structure, it has been conventional practice to provide a stripping member contacting the heated roll structure surface after the nip formed between the pair of fuser rolls which stripping member effects removal of the copy sheet from the heated fuser roll structure.

As shown in FIG. 1, a toner image supporting material is moved between a heated roll structure 1 and a pressure roll 2 and fed out therefrom and subsequently stripped off the heated roll structure by a stripping member 4. This type of arrangement has the drawback that before the the toner image supporting material 3 is stripped by the stripping member 4 it partially contacts the surface of the heater roll structure while being wound with the heater roll structure 1 resulting in the drying of the toner image supporting material 3 which causes the support material to wave or curl. It will be appreciated that such waving or curling adversely affects the capability of transporting the toner image supporting material 3 after fixing. Moreover, in a duplex mode of copying wherein the toner image supporting material is re-used to copy on the reverse side of the support material the affinity of the toner image supporting material for photosensitive materials such as a photosensitive drum is degraded and, therefore, the image transferring process is adversely affected.

Accordingly, the principal object of this invention is to provide a new and improved contact and heat fuser apparatus for electrophotographic copying machines.

It is a more particular object of this invention to provide a new and improved roll fuser apparatus wherein means are provided for minimizing the otherwise adverse effects of the heater roll which result in waving or curling of the copy paper or support material.

BRIEF SUMMARY OF THE INVENTION

Briefly, the above-cited objects are accomplished by the provision of a heated fuser roll structure cooperating with a pressure roll to form a nip through which support material containing toner images thereon is moved with the toner images contacting the heated fuser roll structure. A stripper finger mechanism is provided downstream of the nip formed between the two roll structures in order to pick the support material from the heated fuser roll structure.

In operation, the pressure roll is pivotably mounted so that it can be moved into engagement with the fuser roll structure during a fusing operation and moved out of engagement when the machine is in a standby mode or inoperative. A roller structure is supported by the arm mounting the pressure roll and is brought into engagement with the fuser roll structure in a position intermediate the contact point of the stripper finger mechanism with the fuser roll structure and the aforementioned nip. When a portion of support material is moved out of the nip it moves between the roller member and the heated fuser roll structure and then contacts the aforementioned stripper finger mechanism. The roller member restrains the copy paper or support material and thereby minimizes the otherwise adverse effects of the heated roll structure which tend to cause waving or curling of the support material.

Other objects and advantages of the present invention will become apparent when read in conjunction with the accompanying drawings.

DETAILED DESCRIPTION OF THE PREFERRED EMBODIMENT

Figure 1:
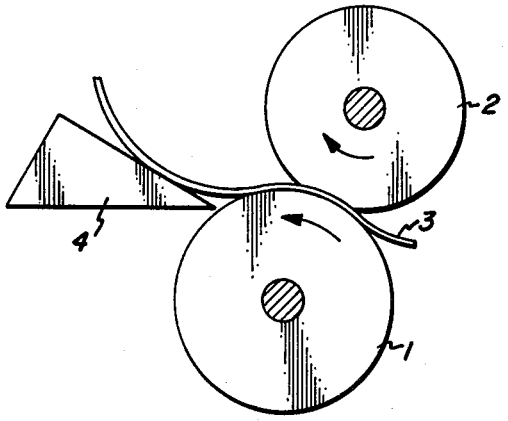
FIG. 1 (PRIOR ART)
FIG. 1 is a schematic view showing a fixing device which is conventional.
Figure 2:
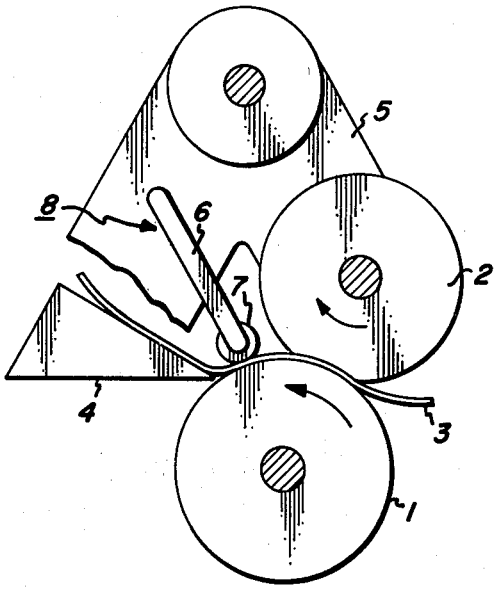
FIG. 2 is a schematic representation of the contact fusing apparatus forming the present invention.

The present invention, as disclosed in FIG. 2, comprises a heated roll structure 1 and a pressure roll structure 2 forming a nip through which a toner image supporting material 3 having toner images thereon is moved with the toner images contacting the heated fuser roll structure. A stripping member 4 in the form of a wedge-shaped finger is provided for picking the support material from the heated fuser roll structure once it has moved through the nip formed between the two roll structures.

In accordance with the present invention there is provided an arm 5 which supports the pressure roll 2 for movement into and out of engagement with the heated fuser roll structure. The arm 5 also supports a restraining member consisting of an arm 6 and a restraining roll 7 which is rotatably supported at the free end of the arm 6 and contacts the heated fuser roll structure when the pressure roll 2 is in contact with the heated roll structure during a heating or fixing operation. The arm 6 and roller 7 together comprise a restraining member 8 which is adapted to restrain the toner image supporting material 3 between the heated roll structure 1 and the roll member 7.

In such an arrangement as described hereinabove, the toner image supporting material 3 which is fed through the nip formed by the heated roll structure 1 and the pressure roll structure 2 adheres wholly to the heated roll 1 until it is stripped by the stripping member 4 and therefore, the drying condition of the toner image supporting material is kept constant thereby minimizing the waving or curling effect on the toner image supporting material 3.

While the invention has been described with respect to the best mode contemplated, it will be appreciated that various modifications may be made without departing from the spirit of the invention. Accordingly, it is not intended that the scope of the coverage sought be limited thereby.

What is claimed is:

1. Contact fuser apparatus for fixing toner images to support material, said apparatus comprising:

a heated roll structure;

a pressure roll structure forming a nip with said heated roll structure through which said support material passes with the toner images contacting said heated roll structure;

means for stripping said support material from said heater roll structure after said material passes out of said nip; and means interposed between said nip and said stripping means for maintaining the drying effect of the heated fuser roll structure on the support material constant thereby minimizing curling of said support material.

2. Apparatus according to claim 1 wherein said means for maintaining said drying effect constant comprises means contacting said support material while said support material is in contacct with said heater roll structure to thereby maintain a contacting relationship between the support and the heated fuser roll structure prior to stripping.

3. Apparatus according to claim 2 wherein said curl minimizing means comprises a roll member.

4. Apparatus according to claim 3 including means for pivotably mounting said pressure roll for effecting engagement thereof with said heated roll structure during fusing of toner images and wherein said roll member is supported by said means for pivotably mounting said pressure roll whereby it is moved into engagement with said heated roll structure simultaneously with said pressure roll contacting said heated roll structure.

* * * * *